United States Patent [19]

Dumser et al.

[11] 4,019,681

[45] Apr. 26, 1977

[54] THERMAL DISTRIBUTING UNIT

[76] Inventors: Josef Dumser, Jakobstrasse 47, 6745 Offenbach; Wilhelm Korner, Logauweg 3, 79 Ulm, both of Germany

[22] Filed: Feb. 12, 1976

[21] Appl. No.: 657,628

[30] Foreign Application Priority Data

Feb. 19, 1975 Germany ..... 2507044

[52] U.S. Cl. ..... 237/63; 237/13; 165/22

[51] Int. Cl.² ..... F24D 3/02

[58] Field of Search ..... 237/56, 59, 63, 8 R, 237/8 D, 13; 165/50, 22

[56] References Cited

UNITED STATES PATENTS

| | | | |
|---|---|---|---|
| 2,006,193 | 6/1935 | Bell | 237/56 |
| 2,026,399 | 12/1935 | Pierce | 237/8 |
| 2,266,162 | 12/1941 | Carlton | 237/59 X |
| 3,257,076 | 6/1966 | Laing et al. | 237/8 |
| 3,371,504 | 3/1968 | Brindley | 165/50 X |

*Primary Examiner*—William E. Wayner
*Assistant Examiner*—William E. Tapolcai, Jr.
*Attorney, Agent, or Firm*—Wenderoth, Lind & Ponack

[57] ABSTRACT

A thermal distributing unit for thermal working fluid, primarily for heating and/or air conditioning purposes, comprises a first or thermal supply stand having a main supply connection and a main return connection for the or each thermal working fluid, a second or electricity supply stand equipped with an electrical connection for receiving an electric power supply from an outside source, and an intermediate structure interconnecting the said first and second stands which structure carries rows of paired subsidiary supply and return connections for the thermal working fluid or fluids. The subsidiary supply and return connections communicate with the main supply and return connections through manifolds on the intermediate structure. The said structure may also carry, for the working fluid or fluids motor-driven circulating pumps and control valves associated with the pairs of subsidiary connections. Control devices for governing conditions in the areas to be supplied with the working fluid or fluids may be disposed on the second stand together with other control devices. The unit may incorporate a water heater for domestic hot water supplies, and distribution connections for supply of the hot water to desired locations. If desired the first stand may provide a main inlet connection for the supply of fuel gas through subsidiary supply connections on the intermediate structure.

13 Claims, 3 Drawing Figures

THERMAL DISTRIBUTING UNIT

BACKGROUND OF THE INVENTION

The invention relates to a thermal distributing unit in which a thermal working fluid supplied by a thermal generator such as an air conditioner or heating device is fed into at least one receiving and circulating system.

Thermal distributing arrangements for the distribution of heating media are known in different forms. Generally these arrangements consist of equipment which comprises the structural components of the heating and electrical installations located on one site, and which is connected to the supply and return lines of the heating device, for example of a boiler heated by oil or electricity. The heat distributing arrangement includes one or more regulating circuits incorporating a circulating pump and a mixing valve which are connected to the various receiving and circulating systems of a radiation-convection heat-exchanger system or a floor-heating system. The assembly of the known distributing arrangements involves costly fitting operations without, in any particular case, providing an optimum wiring system accompanied by low thermal losses, and without enabling worn parts to be readily replaced.

The prior art therefore includes prefabricated distributing and/or connecting arrangements which include components of the electrical regulating system as well as parts of the heating installation, and only a few connections with the heating device and the receiving and circulating systems need to be established. Although this system of combining the most important parts to form single components permits prefabrication and therefore a considerable saving in cost, these connecting units do not meet the requirements imposed by the need for providing a compact construction of distributing unit which is capable of being assembled in all of the conditions likely to be encountered. The possibility of extending the individual heat distributing arrangement is limited, and the best thermal and electrical arrangement of the various components cannot therefore be achieved. The known extension systems can only be regarded as combining the basic elements of the individual installations on a common assembly plate, and such arrangement does not result in a universally applicable compact construction, which represents a practical optimum.

SUMMARY OF THE INVENTION

The present invention is addressed to the problem of providing a thermal distributing unit, particularly a heat-distributing station, but also, where required, a distributing unit for a cooling medium from an air conditioning plant, which unit can be prefabricated with the necessary inlet and outlet connections, and which can be readily adapted to the particular conditions as regards the required capacities, while utilizing space in an economic manner.

According to this invention there is provided a thermal distributing unit comprising a first structure carrying main supply and return connections for a thermal working fluid, a second structure carrying an electrical connection for receiving electric power from an external power source, and an intermediate structure extending between and connected to the first and second structure, which intermediate structure carries a plurality of branch supply connections communicating with said main supply connection for distributing said thermal working fluid from the main supply connection to remote locations and carries a plurality of branch return connections communicating with said main return connection for the return of the working fluid to the main return connection.

Such a thermal distributing unit represents a novel and very advantageous general concept because of the separation of the structures carrying the thermal working fluid supply connections and the electricity supply and a suitable number of intermediate components with connections corresponding to the receiving and circulating systems can be arranged between the two stands. This results in an advantageous short wiring arrangement and in a concentration of the power-carrying means that is advantageous as regards insulation.

In accordance with a further advantageous feature of the invention, the thermal supply structure and the electricity supply structures take the form of upright stands or columns, and the said intermediate components between these columns are arranged in the same sequence, the common distributing connections leading to the intermediate components being arranged in at least one transverse chamber between the heat-supply stand and the electric supply stand. Such transverse chamber between the stands may be expediently located below the intermediate components, but, if required, above or below these intermediate components. In some circumstances, single intermediate components can be advantageously brought together to form further sub-structures which contain a plurality of similar intermediate components. The intermediate components may be located with advantage above and below the transverse chamber or other components between the stands.

Expediently, the intermediate components may comprise all the conveying and control units required for the regulating circuits, such as circulating pumps with their motor drive and mixing valves. Particular advantage accrues from the use of circulating pumps in which the motor drive is enclosed in the pump casing. Automatic units of this kind which combine pumps, mixers and regulating and control devices are known.

A particular advantage regarding space utilization and adaptability in the subsequent extension of a given distributing station can be achieved by forming the heat-supply stand and the electric supply stand as units which are free-standing.

For some applications it appears advantageous to design the distributing unit as a main distributing unit for direct connection to the central heat-producer or heat-exchanger or to central ventilation and air conditioning equipment and to house the distributing station in the central power installation, provided in a basement room or a loft, or to accommodate it in a sub-station for the long-distance supply of heat.

Particularly in the case of large buildings, advantage is offered by a further method of installation in which the distributing unit is designed as a distributing sub-station which serves one floor of a building and has connections for lines running to the central heat-producer or heat-exchanger or to the thermal generator. When the system is used in conjunction with a central thermal generator, then, as in the known electrical installation, rising supply and return lines are provided which can be connected to the distributing sub-stations on the various floors of the building. In the case of large premises, this general concept offers considerable advantages as regards economies in wiring as regards insulation of the distributing lines. Furthermore, a very desirable saving in power is achieved because of the low heat-losses. It may also be expedient to connect the distributing sub-stations to associated thermal generators on each of the floors of the building, so that supply units are provided which are independent of each other.

In some cases a further advantage can be achieved in the last-mentioned arrangement by designing the distributing unit to extend over the floor-to-ceiling height of a storey. This results in an arrangement of pleasing appearance, in efficient insulation of the heating installation and therefore in a saving in power costs, and in the necessary electrical installations being covered in a fireproof manner.

Considerable advantage is obtained if the distributing station incorporates an integrated water heater. Preferably, this water heater is a heat-exchanger the primary fluid flow circuit of which is supplied with hot water from the heat-supply stand, or is an electric boiler the current supply of which is derived from the electric supply stand. Thus, in addition to heating or cooling the premises, the system can provide the hot water that is required for general use in many cases.

The above-described basic concept of a thermal distributing unit incorporating thermal supply and electric supply stands and intermediate components disposed between these stands can be varied in a large number of ways to provide a unit that is either free-standing or takes the form of a block station of greater size which is built into a recess in the wall of a building. Here, it may be desirable for two distributing units arranged with their similar supply stands facing each other, to form one block distributor. In a larger arrangement, the distributing units may be arranged in a row with their thermal supply stands opposite each other, each two opposite thermal supply stands with two further opposite thermal supply stands being connected by an interposed transverse connection to a thermal generator or to corresponding supply lines.

The use of the features of the invention results in a compact thermal distributing unit which economizes in space and power and which can be adapted to deal with all power-distributing problems that may arise and which mainly uses prefabricated components in the best arrangement and correlationship.

BRIEF DESCRIPTION OF THE DRAWINGS

The attached drawings illustrate diagrammatically some forms of construction of the subject matter of the invention and indicate further features of the invention. In the drawings.

DETAILED DESCRIPTION OF THE INVENTION

Figure 1:
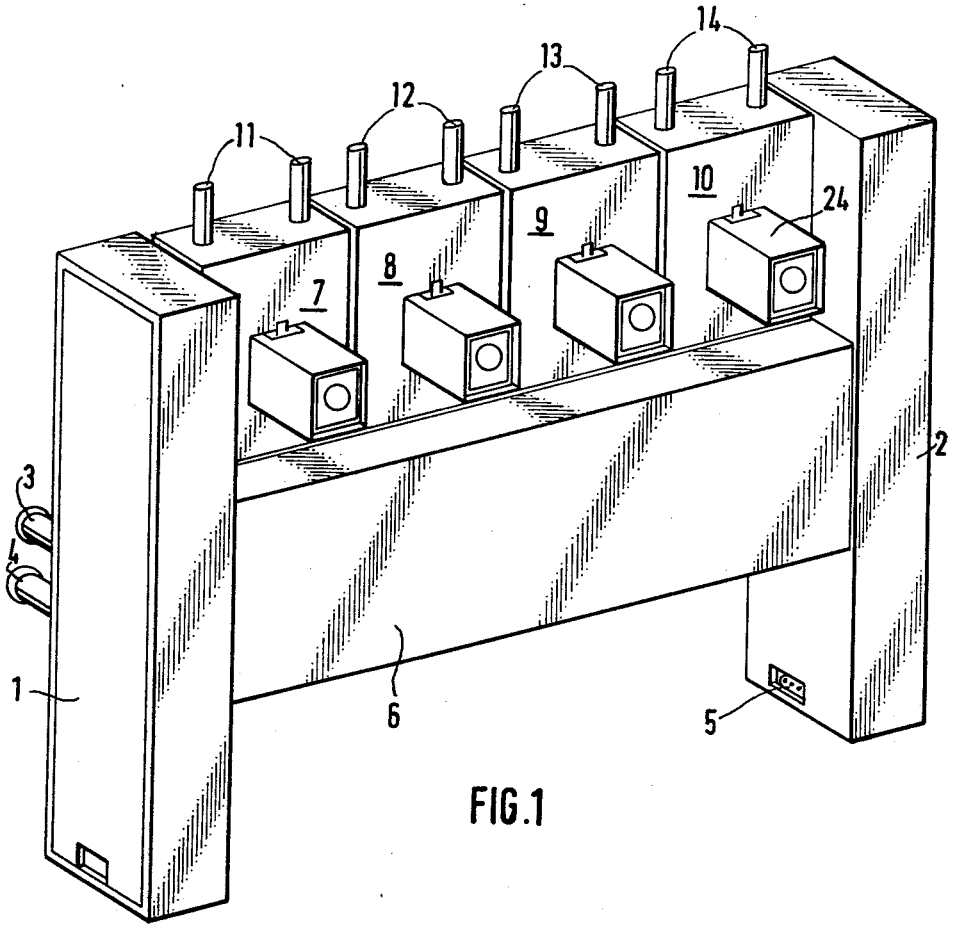
FIG. 1 shows a perspective view of compact distributing unit in accordance with a first arrangement of the invention.

FIG. 1 shows a free-standing distributing unit which comprises a heat-supply stand 1 and an electricity supply stand 2. Fitted on the heat-supply stand 1 are connections 3 and 4 for the supply and return lines for the thermal working fluid provided by a thermal generator, not illustrated. The electricity supply stand 2 is provided with a main electricity supply connection 5.

Above a transverse chamber 6, which accommodates components of the electrical installation and of the heating installation as well as of a domestic water heater, are four intermediate components 7, 8, 9 and 10 which have input and output connections 11, 12, 13 and 14 for four regulated systems for receiving and circulating the working fluid.

If required, the compact distributing station shown in FIG. 1 may contain other parts, not described in detail herein, e.g. a plug-in tapping device for supplying fuel-oil burners, together with oil pumps, oil filters, separators and oil-meters. When gas-burning devices are used, the heat-supply stand 1 may accommodate the appropriate devices including safety means.

The electricity supply stand is expediently provided with measuring, control and regulating instruments, apparatus for controlling temperature in various areas, as well as collective breakdown indicating devices and audible warning devices; furthermore this stand may be provided with electrical leakage-indicating devices for monitoring the fuel and supply containers.

Figure 2:
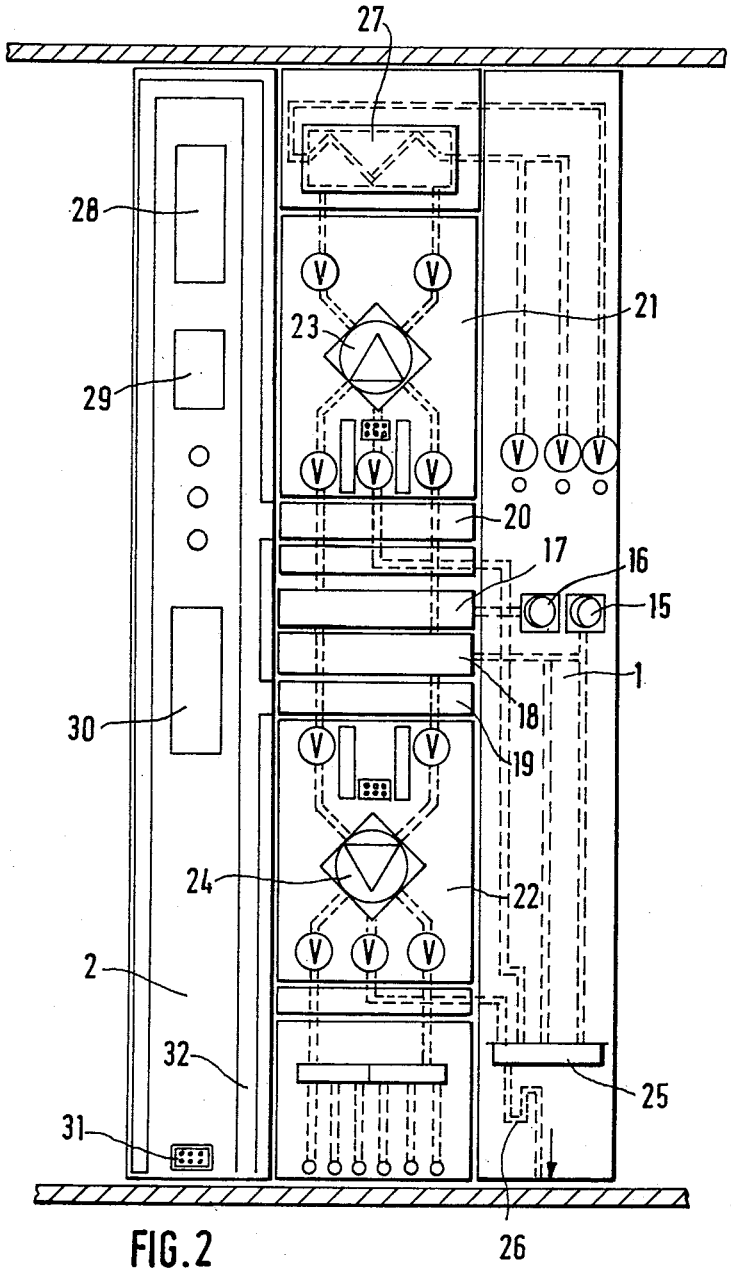
FIG. 2 is a diagrammatic front view of a distributing unit which extends from the floor to the ceiling of a floor of a building according to a second arrangement of the invention, the various elements associated with the station being represented by circuit-diagram symbols.

Details of the internal construction of the heat-supply stand, the intermediate components and the electric supply stand are shown in the alternative arrangement illustrated in FIG. 2. Here, the distributing station, comprising a heat-supply stand 1 and an electricity supply stand 2, extends from floor to ceiling and is designed to be built into a recess below or on a wall surface. Above the heat-supply stand 1 and the main heat-distributing supply and return connections 15 and 16, which are built into the stand and are ready for connection to the boiler, the working fluid is passed to horizontal heat manifolds 17 and 18. Components 19 and 20, also disposed horizontally, contain parts of the electrical installation. The manifolds 17 and 18 and the components 19 and 20 together constitute the fittings contained in the transverse chambers.

In two intermediate components 21 and 22, arranged respectively above and below the components 20 and 19, are provided regulating circuits 23 and 24 which accommodate combined automatic pumping, mixing, regulating and control means, bronze shut-off discs, emptying devices, air-exhaust devices, a servo-motor and electronic control and switching elements including the remote-reading thermometers for the supply and return lines associated with the regulating circuit and for the heat supply and return lines.

The heat-supply stand 1, which is advantageously provided with a complete covering of thermal insulation material, contains components of the filling and emptying devices, a collective sump 25 and drainage pipe 26 serving the various regulating circuits. Also provided in the thermal supply stand 1 are automatic air-exhaust valves for the heating supply and return lines, remote-reading thermometers and pressure-monitoring instruments for the heat distributor.

Located between the heat-supply stand 1 and the electric supply stand 2 is a continuous-flow water heater 27, which is incorporated in the distributing unit and which, on the heat-supply and water-supply side is likewise fed from the heat supply stand 1.

The electricity supply stand 2 serves to accommodate all the necessary electrical indicating, signalling and switching devices 28, 29 and 30, and connecting and distributing terminals 31 for connecting the main current-supply, the ambient temperature sensor and the regulating circuit elements. All the lines are rendered readily accessible, when alterations or extensions are to be made, by accommodating the wiring in a cable duct 32.

A very wide variety of control, regulating and monitoring means to suit the particular installation can be housed in the electric supply stand. Such means may include the burner control device for oil-burning and gas-burning installations, the control devices for block storage installations and hot water storage units for electric immersion heater boilers and for other heat-producers. Furthermore, this stand can accommodate control and regulating devices for the hot water circulation pumps, the charging pumps, the oil pumps and the electric valves.

In addition ventilation and air-conditioning apparatus, controlled on the heat, cold and air sides, can be accommodated in the intermediate components between the heat-supply stand 1 and the electricity supply stand 2.

The use of a distributing unit on a floor of a building also results in considerable saving in power. A stable sheet-steel construction is preferred for the heat-distributing unit, which has removable inspection doors whereby the terminals and other internal parts can be easily reached.

Figure 3:
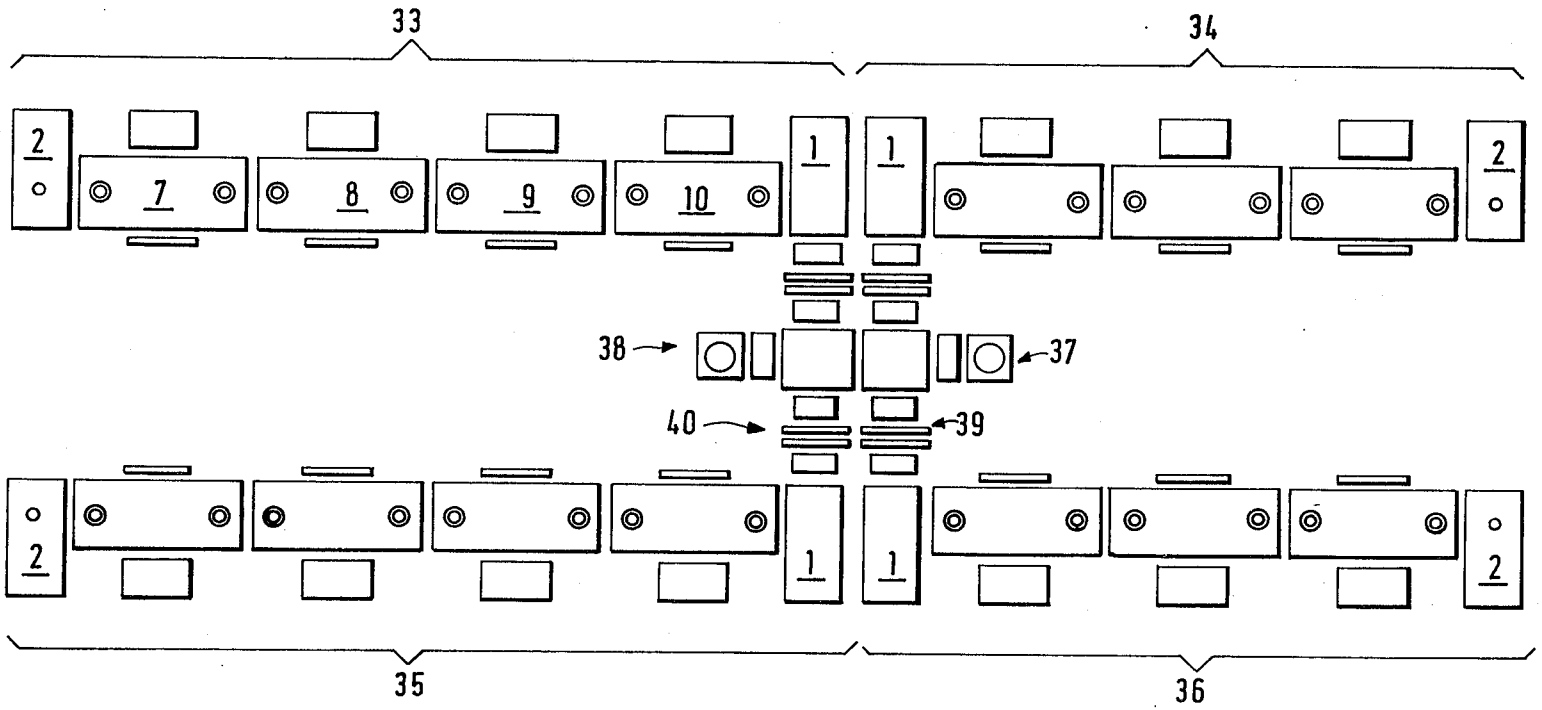
FIG. 3 shows an arrangement comprising fourteen receiving and circulating systems in an installation comprising four distributing units which are arranged in the shape of a H and form a block distributor.

FIG. 3 illustrates the combination of four distributing units 33, 34, 35 and 36 forming a free-standing block heat distributor, the feed to end the return from the thermal generator, not illustrated in the drawing, being achieved by way of connecting elements 37 and 38. The various distributing units, for example unit 33, each contain an electricity supply stand 2 and a heat-supply stand 1, between which are inserted intermediate components, e.g. 7, 8, 9 and 10, in an arrangement as disclosed in FIG. 1.

The thermal supply stand is intended to carry service connections not only thermal working fluids such as hot water and hot air, but all thermal domestic service media such as domestic hot and cold water. If the installation as a whole also employs gaseous media, appropriate supply connections and lines can likewise be accommodated with advantage in the thermal supply stand and, if required, they will extend through suitable intermediate components.

The H-shaped arrangement with a transverse portion can be used in the vertical and horizontal positions.

We claim:

1. A thermal distributing unit comprising a first structure carrying main supply and return connections for a thermal working fluid, a second structure carrying an electrical connection for receiving electric power from an external power source, and an intermediate structure extending between and connected to the first and second structures, which intermediate structure carries a plurality of branch connections communicating with said main supply connection for distributing said thermal working fluid from the main supply connection to remote locations and carries a plurality of branch return connections communicating with said main return connection for the return of the working fluid to the main return connection.

2. A unit as claimed in claim 1, wherein said intermediate structure carries supply and return manifolds which are in communication with said main supply and return connections respectively, said branch supply connections being arranged in a row and leading off the supply manifold and said branch return connections being arranged in a second row and leading to the return manifold.

3. A unit as claimed in claim 2, wherein said intermediate structure comprises an enclosed housing in which the two manifolds are disposed.

4. A unit as claimed in claim 1, further comprising motor-driven circulating pumps and control valves connected in flow circuit with the respective pairs of branch inlet and outlet connections.

5. A unit as claimed in claim 1, further incorporating a water heater for supplying hot water to a remote location.

6. A unit as claimed in claim 5, wherein the water heater is a heat exchanger and has a primary flow circuit connected to be supplied with heating fluid from said main supply connection.

7. A unit as claimed in claim 1, wherein said first and second structures and said intermediate structure together form an H-shaped arrangement.

8. A unit as claimed in claim 1, wherein said first and second structures are free-standing.

9. A unit as claimed in claim 7, wherein said first and second structures extend horizontally and the intermediate structure extends vertically.

10. A thermal distributor installation in a building having a floor and a ceiling, which installation incorporates a unit extending from said floor to said ceiling, said unit comprising a first structure carrying main supply and return connections for a thermal working fluid, a second structure carrying an electrical connection for receiving electric power from an external power source, and an intermediate structure extending between and connected to the first and second structures, which intermediate structure carries a plurality of branch supply connections communicating with said main supply connection for distributing said thermal working fluid from the main supply connection to remote locations and carries a plurality of branch return connections communicating with said main return connection for the return of the working fluid to the main return connection.

11. A thermal distribution installation incorporating a plurality of thermal distributing units, each of which units comprises a first structure carrying main supply and return connections for a thermal working fluid, a second structure carrying an electrical connection for receiving electric power from an external power source, and an intermediate structure extending between and connected to the first and second structures, which intermediate structure carries a plurality of branch supply connections communicating with said main supply connection for distributing said thermal working fluid from the main supply connection to remote locations and carries a plurality of branch return connections communicating with said main return connection for the return of the working fluid to the main return connection, said units being grouped together with their respective first structures adjacent each other, and said installation further comprising a common inlet connection with branch connections leading to the respective main supply connections of said units and a common outlet connection with branch connections connected to the respective main return connections of said units.

12. A heat distribution unit comprising an upright heat supply stand having main supply and return connections for a heating fluid to be supplied from and returned to an external source, an upright electricity supply stand having an electrical connection for receiving electric power from an external source, and a horizontal intermediate structure extending between and connected to the heat and electricity supply stands, which intermediate structure carries a plurality of branch supply connections communicating with said main supply connection for distributing said thermal working fluid from the main supply connection to remote locations and carries a plurality of branch return connections communicating with said main return connection for the return of the working fluid to the main return connection, each of the branch supply connections being paired with one of said branch return connections, and a motor-driven circulating pump and a control valve connected in series in one of the branch connections of each pair and the manifold to which such branch connection is connected, and electrical control means for controlling said pumps and valves mounted on the electricity supply stand.

13. A Thermal distributing unit comprising a first column structure having essentially thermal components and carrying main supply and return connections for a thermal working fluid, a second column structure having essentially electrical components and carrying an electrical connection for receiving electric power from an external power source, and an intermediate structure carrying a number of intermediate units communicating with said main supply connection for distributing said thermal working fluid from the main supply connection and communicating with said main return connection for the return of the working fluid to the main return connection, the number of said intermediate units corresponding to the number of controlled thermal distributing circuits, each intermediate unit having input and output connections for receiving and circulating the working fluid, in its controlled thermal circuit.

* * * * *